United States Patent [19]

Sprengers

[11] 3,956,656

[45] May 11, 1976

[54] DISCHARGE TUBE HAVING TWO INTERNAL ELECTRODES

[75] Inventor: Leo Modest Sprengers, Eindhoven, Netherlands

[73] Assignee: U.S. Philips Corporation, New York, N.Y.

[22] Filed: Nov. 29, 1974

[21] Appl. No.: 528,075

[30] Foreign Application Priority Data

Dec. 19, 1973 Netherlands ..... 7317359

[52] U.S. Cl. ..... 313/181; 313/227

[51] Int. Cl.[2] ..... H01J 61/24

[58] Field of Search ..... 313/174, 181, 227

[56] References Cited

UNITED STATES PATENTS 3,784,863 1/1974 Scott ..... 313/174

*Primary Examiner*—R. V. Rolinec
*Assistant Examiner*—Darwin R. Hostetter
*Attorney, Agent, or Firm*—Frank R. Trifari

[57] ABSTRACT

The invention relates to a low-pressure sodium-vapour discharge lamp which contains an excess of sodium. According to the invention the discharge tube contains a capillary connecting duct extending from a pool of liquid sodium. The provision of the capillary connecting duct prevents the power consumption of the lamp from increasing during the life of the lamp.

9 Claims, 6 Drawing Figures

DISCHARGE TUBE HAVING TWO INTERNAL ELECTRODES

Figure 1:
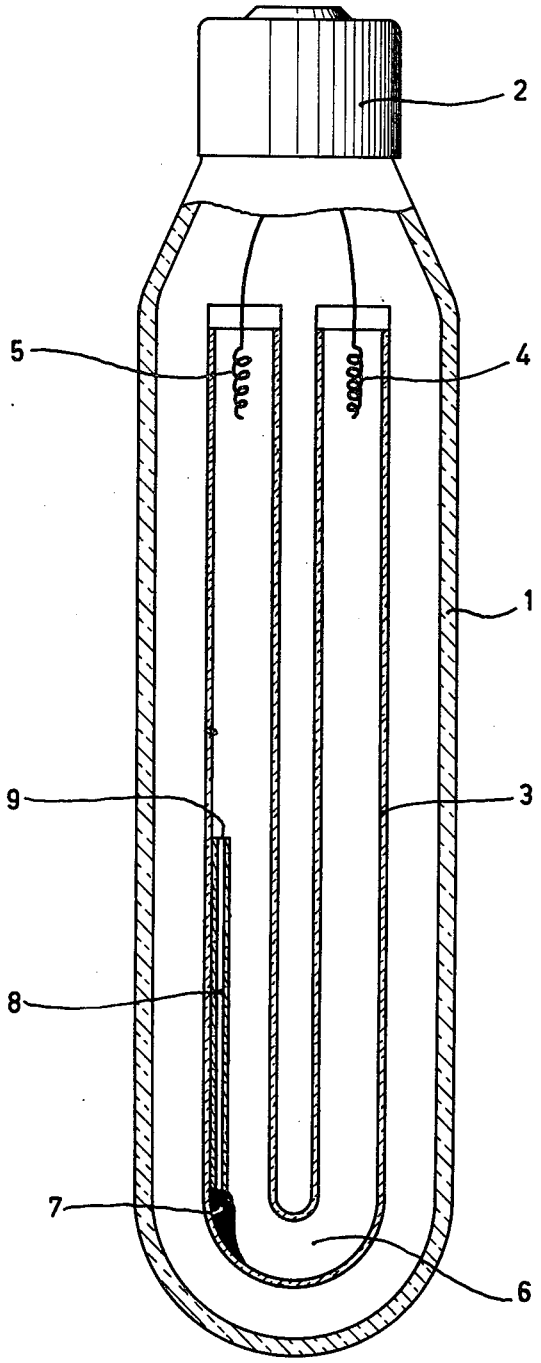

The invention relates to a discharge tube having at least two internal electrodes, in the operative condition of which discharge tube a liquid which contains a metal is present in a discharge chamber of the tube, a capillary connecting duct being provided a first end of which is disposed at the location of the liquid while a second end is disposed in the discharge chamber. In the operational condition of the discharge tube the second end of the connecting duct has a higher temperature than the first end and at least part of the liquid is conveyed through the connecting duct from the first end to the second one.

The term "metal" is to be understood to mean: one metal (for example sodium) or a combination of metals (for example an amalgam) or a metal compound (for example sodium iodide).

The term "capillary connecting duct" is to be understood to mean a duct the material of which is wetted by the said liquid and the effective cross-sectional area of which is so small that a capillary effect is obtainable in the duct containing the liquid.

A known discharge tube of the aforementioned type is described, for example, in French Pat. No. 1,463,568. A disadvantage of this known discharge tube is that the second end of the capillary connecting duct lies near the rear end of an electrode. This means that with respect to the temperature of this second end of the capillary connecting duct the choice is narrowly restricted. This is due to the fact that the temperature is closely tied to the temperature of the rear end of the electrode.

It is an object of the present invention to provide a discharge tube of the aforementioned type which permits a wider choice of the temperature of the second end of the capillary connecting duct. It should be mentioned that the temperature of this second end is one of the factors which determine the vapour pressure in the discharge tube. This is because the temperature of said second end represents the highest temperature at which the substance which takes part in the discharge still is in the liquid state. Hence a wider choice of this temperature is very useful.

A discharge tube according to the invention having at least two internal electrodes, in which discharge tube in the operative condition a liquid which contains a metal is present in a discharge chamber of the tube, a capillary connecting duct being provided a first end of which is disposed at a location of the liquid while the second end is disposed in the discharge chamber. In the operational condition of the discharge tube the second end of the connecting duct has a higher temperature than the first end and at least part of the liquid is conveyed through the connecting duct from the first end to the second end, is characterized in that the second end of the capillary connecting duct is disposed between the two electrodes.

An advantage of a discharge tube according to the invention is that the temperature of the second end of the capillary connecting duct and hence the vapor pressure of the substance which takes part in the discharge can be chosen within wide limits. In actual fact the invention is based on the recognition that the heat required near the second end of the capillary connecting duct for vaporizing the liquid can be derived from the discharge between the two electrodes.

The location of the liquid may be, for example, intermediate the electrodes. As an alternative it may be in an appendix of the discharge tube. As a second alternative it may be situated behind an electrode.

In a preferred embodiment of a discharge tube according to the invention in which this tube is elongate the capillary connecting duct is arranged near the wall of the discharge tube, the duct being substantially parallel to the axis of the discharge tube at this location.

The term "axis of the discharge tube" is to be understood to mean the line joining the centres of the cross-sections of the discharge tube.

An advantage of the said preferred embodiment is that the capillary connecting duct substantially does not interfere with the discharge in the tube.

The capillary connecting duct may comprise a fine-bore tube open at both ends. The capillary connecting duct may also be a tube which not only is open at the ends but also has at least one opening in its side wall. In a further embodiment of the capillary connecting duct this may be a groove formed in the inner surface of the discharge tube. Furthermore the capillary connecting duct may be a slit between the inner wall of the discharge tube and a thin rod which locally is secured to this wall.

In another preferred embodiment of a discharge tube according to the invention, in which the tube is elongate, at least part of the capillary connecting duct extends transversely with respect to the axis of the discharge tube.

An advantage of this embodiment is that the capillary connecting duct may as a rule be comparatively short, because when the connecting duct extends in the said direction transverse with respect to the axis of the discharge tube comparatively soon a point is found at which the temperature is high enough for the second end of the capillary connecting duct.

A further improvement of the latter preferred embodiment is obtained if the part of the capillary connecting duct which extends transversely with respect to the axis of the discharge tube is perpendicular to this axis and the second end of the capillary connecting duct is disposed near said axis.

An advantage of this further improvement is that the capillary connecting duct can be very short and hence can consist of a very small amount of material so that its presence substantially does not interfere with the discharge. A further advantage is that owing to this small amount of material the conduction of heat through the duct is small.

Another improvement of the preferred embodiment of a discharge tube according to the invention is obtained by shaping the capillary connecting duct in the form of a spiral, the second end of the duct being disposed near the axis of the discharge tube.

An advantage of this further improvement is that the capillary connecting duct can simply be mounted in a discharge tube. The spiral is inserted on edge into the discharge tube so that its outer surface is gripped by the inner wall of the discharge tube.

As mentioned hereinbefore, the connecting duct may have various forms, for example that of a groove in the inner wall of the discharge tube or that of a slit between a wire and the inner wall of the discharge tube.

In a still further preferred embodiment of a discharge tube according to the invention the wall of the capillary connecting duct comprises at least two adjacent wires which may be twined or plaited or braided.

An advantage of this preferred embodiment is that it renders possible a very simple connecting duct whilst the material of the wall of the discharge tube has become unimportant with respect to the capillary transport of the liquid.

In a further preferred embodiment of a discharge tube according to the invention in which the discharge tube takes the form of a U-shaped low-pressure sodium-vapour discharge lamp, in the bend of which U-shaped tube the liquid sodium is stored, the length of the capillary connecting duct is made so that the second end of this duct — in the operational condition of the discharge tube — has a temperature of at least 250°C.

An advantage of this preferred embodiment is that the sodium in the discharge tube always can have a sufficiently high vapour pressure. As is known, in the case of a low-pressure sodium-vapor discharge tube the vapor pressure has an optimum value at a temperature of about 260°C.

Figure 2:
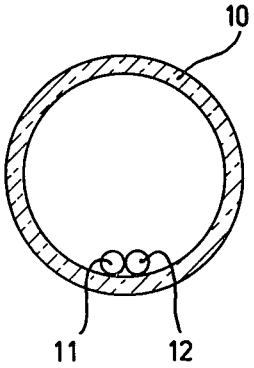
Figure 3:
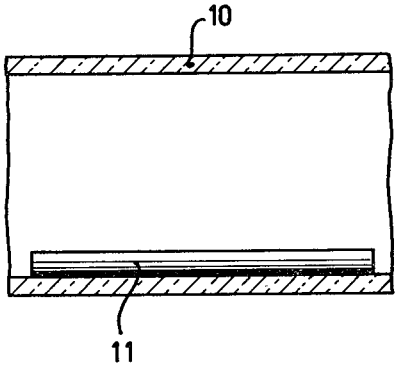
Figure 4:
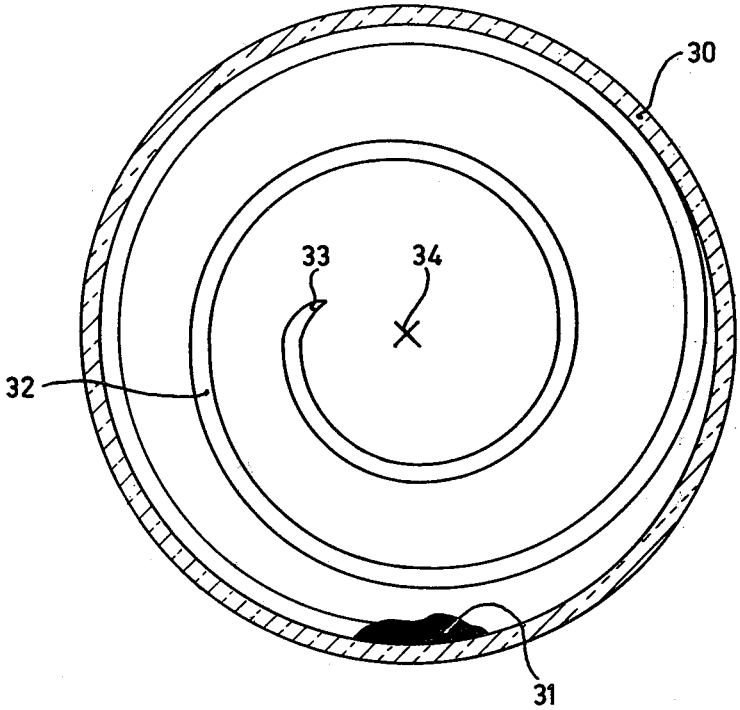
Figure 5:
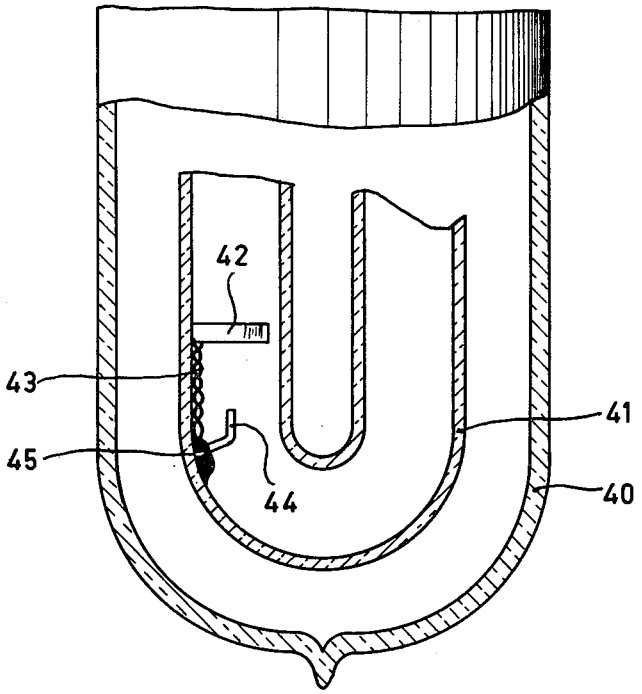
Figure 6:
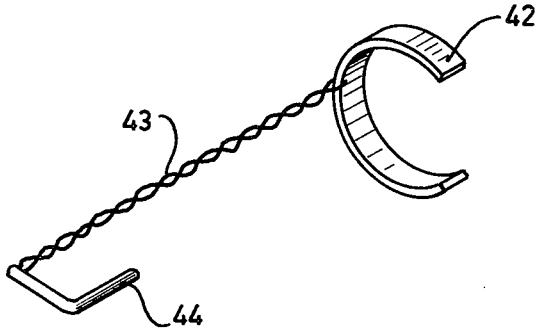

Embodiments of the invention will now be described, by way of example, with reference to the accompanying diagrammatic drawings, in which:

FIG. 1 shows a low-pressure sodium-vapor discharge lamp according to the invention, FIG. 2 is a cross-sectional view of a discharge tube of a second discharge lamp according to the invention, FIG. 3 is a longitudinal sectional view of part of the lamp according to the invention shown in cross-section in FIG. 2, FIG. 4 is a cross-sectional view of a discharge tube of a third discharge lamp according to the invention, FIG. 5 is a part sectional view part elevation of a part of a fourth discharge lamp according to the invention, and FIG. 6 is a perspective view of a detail of the capillary connecting duct of the lamp of FIG. 5 and a member for securing this duct.

Referring now to FIG. 1, a low-pressure sodium-vapor discharge lamp has an outer jacket 1. The lamp absorbs about 90 watts. Reference numeral 2 denotes a lamp cap. A U-shaped discharge tube 3 is accommodated in the jacket 1. The discharge tube 3 has electrodes 4 and 5. The bend of the discharge tube 3 is designated by 6. In this bend an amount of liquid sodium 7 is accommodated, even in the operational condition of the lamp. Reference numeral 8 denotes a capillary tube made of gehlenite a first end of which is inserted into the liquid 7 while the other end 9 is situated nearer to the electrode 5. In the operational condition of the discharge lamp liquid sodium will be conveyed by capillarity from the first end in the liquid through the tube 8 to arrive at the opening 9. Owing to the elevated temperature at this second end the conveyed sodium evaporates to take part in the discharge. At the location of 7 sodium vapor will recondense. Thus the sodium effectively performs a cycle in which it is transported from the colder location 7 to the hotter location 9 through the capillary connecting duct 8. In a practical embodiment the length of the tube 8 was about 15 cm, its inner diameter was about 200 $\mu$m and its wall thickness about 70 $\mu$m. The overall length of the discharge tube 3 was about 2 × 40 cm. The temperature of the liquid supply 7 was about 230°C. The temperature of the other end 9 of the connecting duct 8 was about 260°C.

In the low pressure sodium vapor discharge lamp according to FIG. 1, initially a power of about 90 watts was absorbed. After operation for 1,000 hours no increase of this wattage was found. In known low-pressure sodium-vapor discharge lamps not according to the invention in which the discharge tube was provided with bosses, it was found that in some cases after operation for about 1,000 hours the liquid sodium initially contained in the bosses had largely disappeared therefrom and had collected in the bend of the discharge tube. In such a case, not according to the invention, the power initially consumed by the lamp was about 90 watts also. However, after the said operating time of 1,000 hours the power consumption had risen by about 6% (compared with the initial situation). Such a rise in the power consumption is disadvantageous, inter alia because it has to be allowed for when designing a lighting system to be equipped with the said lamps.

A further advantage of the lamp according to the invention over the latter known lamp is that the lamp according to the invention need not be provided with bosses.

FIGS. 2 and 3 are a cross-sectional view and a longitudinal sectional view respectively of a modified embodiment of a discharge tube 10 similar to that of the tube 3 of FIG. 1. Reference numerals 11 and 12 denote contiguous gehlenite rods. The rods form the wall of a capillary connecting duct for the transport of the sodium.

FIG. 4 shows on an enlarged scale a cross-section of a modified discharge tube which also is of a type similar to that of the tube 3 of FIG. 1. The tube is designated by 30. Reference numeral 31 designates a supply of liquid sodium at a prepared position in the discharge tube. Reference numeral 32 denotes a spiral connecting duct of capillary cross-sectional dimensions, the spiral extending at right angles to the direction of length (axis) of the discharge tube. The second end 33 of the capillary connecting duct 32 is located near the axis 34 of the discharge tube. Again, the temperature of the liquid at the prepared position 31 was 230°C and that of the end 33 was higher than 250°C in the operational condition of the discharge tube. The spiral 32 consisted of three intertwined wires of platinum-plated molybdenum which each had a diameter of about 100 $\mu$m.

In the operation of the embodiment of FIG. 4 also, it was found that the power consumption of the discharge lamp did not exhibit the increase of the said known embossed lamp.

In FIG. 5 reference numeral 40 denotes part of the outer jacket of a low-pressure sodium-vapor lamp of a type similar to that shown in FIG. 1. A part of the U-shaped discharge tube is designated by 41. A horseshoe-shaped clip 42 (see FIG. 6 also) resiliently engages the inner wall of the discharge tube 41. The clip 42 is connected to the capillary connecting duct 44 proper (which is made of platinum-plated molybdenum) by intertwined metal wires 43. The base of the duct 44 and the wires 43 are partly disposed in the storage station of a sodium liquid 45. This storage station corresponds to the station 7 of the lamp of FIG. 1. The clip 42 serves to secure the capillary connecting duct 44 in the discharge tube 41. Operation of the capillary duct 44 is equivalent to that of the duct 8 of FIG. 1. An advantage of the lamp of FIG. 5, however, is the considerably smaller length of the capillary connecting duct.

The invention has been described with reference to examples which relate to low-pressure sodium-vapor discharge lamps. As an alternative, however, the invention may be applied to other discharge tubes, for example to mercury-vapor discharge tubes. Furthermore, the invention is not restricted to the low-pressure discharge tubes but may as well be used in the case of high-pressure discharge tubes, for example in a high-pressure sodium-vapor discharge lamp or a high-pressure metal halide lamp.

It is not necessary for the capillary connecting duct to be entirely accommodated in the discharge chamber. Part of the connecting duct may extend beyond the discharge chamber.

What is claimed is:

1. A lamp having a discharge tube having a storage station for a liquid, at least two internal electrodes, a material containing a metal which is at least partly a liquid during operation of said lamp, said material being disposed in said tube, and means for transporting liquid from said storage station during lamp operation which comprise a capillary disposed in said discharge tube having first and second open ends, said first end being in fluid communication with said storage station and said second end being disposed in said discharge chamber intermediate said two internal electrodes, the second end of the capillary having a higher temperature than said first end.

2. A lamp as claimed in claim 1 in which the discharge tube is elongate, characterized in that the capillary is arranged near the wall of the discharge, the capillary being substantially parallel to the axis of the discharge tube at this location.

3. A lamp as claimed in claim 1, in which at least a part of said capillary extends transversely with respect to the axis of the discharge tube.

4. A lamp as claimed in claim 3, characterized in that said part of the capillary which extends transversely with respect to the axis of the discharge tube is substantially perpendicular to said axis and said second end of the capillary is disposed near said axis.

5. A lamp as claimed in claim 3, wherein said capillary has a spiral form and said second end is disposed near the axis of the discharge tube.

6. A lamp as claimed in claim 1, further including at least two adjacent wires disposed on the interior wall of said discharge tube.

7. A lamp as claimed in claim 3, wherein said discharge tube is a U-shaped low-pressure sodium-vapor discharge lamp having a storage station for sodium liquid disposed in the bend of the U-shaped discharge tube, the length of the capillary being dimensioned so that the second end of said capillary in the operational condition of said discharge tube has a temperature of at least 250°.

8. A lamp as described in claim 1 wherein said capillary is an elongated capillary tube.

9. A lamp as described in claim 8 wherein said elongated capillary tube has a rectilinear axis.

* * * * *

UNITED STATES PATENT AND TRADEMARK OFFICE

CERTIFICATE OF CORRECTION

PATENT NO. : 3956656

DATED : May 11, 1976

INVENTOR(S) : Leo Modest Sprengers

It is certified that error appears in the above-identified patent and that said Letters Patent are hereby corrected as shown below:

Column 1, line 16
"one" should be --end--

Signed and Sealed this

Seventh Day of December 1976

[SEAL]

*Attest:*

RUTH C. MASON
*Attesting Officer*

C. MARSHALL DANN
*Commissioner of Patents and Trademarks*